US006514466B2

(12) United States Patent
Labriola et al.

(10) Patent No.: US 6,514,466 B2
(45) **Date of Patent: *Feb. 4, 2003**

(54) PIPETTE-TIP STORAGE DEVICE

(75) Inventors: Anthony M Labriola, Woburn, MA (US); Joseph C Wall, Southborough, MA (US)

(73) Assignee: Corning Incorporated, Corning, NY (US)

( * ) Notice: Subject to any disclaimer, the term of this patent is extended or adjusted under 35 U.S.C. 154(b) by 38 days.

This patent is subject to a terminal disclaimer.

(21) Appl. No.: 09/971,150

(22) Filed: Oct. 3, 2001

(65) Prior Publication Data

US 2002/0009398 A1 Jan. 24, 2002

Related U.S. Application Data

(63) Continuation of application No. 09/527,545, filed on Mar. 16, 2000, now Pat. No. 6,328,933.

(51) Int. Cl.[7] ..... B01L 3/02; B01L 3/00; B01L 9/00; B65D 1/34; A47B 73/00

(52) U.S. Cl. ..... 422/104; 422/99; 422/100; 206/562; 206/558; 211/74; 211/85.13

(58) Field of Search ..... 422/99, 100, 104; 206/562, 558; 211/74, 85.13

(56) References Cited

U.S. PATENT DOCUMENTS

| | | | | |
|---|---|---|---|---|
| 5,057,282 | A | 10/1991 | Linder | 422/104 |
| 5,318,753 | A | 6/1994 | Honda | 422/104 |
| 5,324,482 | A | 6/1994 | Scaramella et al. | 422/100 |
| 5,392,914 | A | 2/1995 | Lemieux et al. | 206/499 |
| 5,441,702 | A | 8/1995 | Lemieux et al. | 422/100 |
| 5,445,270 | A | 8/1995 | Dratz | 206/443 |
| 5,470,538 | A | 11/1995 | Lind | 422/104 |
| 5,487,997 | A | 1/1996 | Stolp | 436/54 |
| 5,612,000 | A | 3/1997 | Lemieux | 422/100 |
| 5,622,676 | A | 4/1997 | Lind | 422/104 |
| 5,630,988 | A | 5/1997 | Stolp | 422/100 |
| 5,642,816 | A | 7/1997 | Kelly et al. | 211/60.1 |
| 5,779,984 | A | 7/1998 | Kelly et al. | 422/104 |
| 5,948,362 | A | 9/1999 | Steinbrenner et al. | 422/100 |
| 6,007,779 | A | 12/1999 | Lemieux et al. | 422/100 |
| 6,098,819 | A | 8/2000 | Link | 211/85.13 |
| 6,221,317 | B1 | 4/2001 | Carl | 422/104 |

*Primary Examiner*—Jill Warden
*Assistant Examiner*—Brian R Gordon
(74) *Attorney, Agent, or Firm*—Vincent T. Kung

(57) ABSTRACT

A reusable pipette-tip holder that doubles the density of the number of pipette tips able to be stored within a single container, while conserving the total amount of material, packaging and storage space. The invention creates a rigid box by the joining, bottom to bottom, of two pipette-racks each having a standard matrix of pipette-receiving holes. The new design permits pipettes to be inserted from both the top and bottom of the box, because the centerline spacing of the rows of pipette-receiving holes on the top and bottom surfaces is offset with respect to each other. Rows of pipette tips from one side of the container nest between the free space in adjacent rows of tips inserted from the other side of the container.

16 Claims, 2 Drawing Sheets

PIPETTE-TIP STORAGE DEVICE

CLAIM OF PRIORITY

The present Application is a continuation Of and claims priority to Ser. No. 09/527,545, now U.S. Pat. No. 6,328,933, filed on Mar. 16, 2000, "DOUBLE DENSITY PIPETTE TIP STORAGE RACK," in the names of Anthony M. Labriola and Joseph C. Wall, the entire content of which is incorporated herein.

BACKGROUND

The use of pipette devices for the transfer and dispensing of precise quantities of fluids in analysis is well known. Likewise, disposable plastic tips used with pipetting devices have been commercially available for decades. These tips are used with pipetting devices that may use 1, 8, 12, or 96 tips simultaneously, and are usually packed vertically in a pipette tip rack.

The function of a pipette tip rack is to organize disposable pipette tips in a manner for convenient placement on a pipette. A pipette tip rack is usually a plastic container or box that has a number of holes, 96 for example, into which pipette tips are placed. A rack with 96 holes has the holes arranged typically in an eight by twelve array that is spaced approximately 9 mm apart on their centerlines. Generally, such racks comprise a rigid base with substantially vertical sides joined with a flat supporting plate that holds an array of pipette tips in holes that extend through the plate. Pipette tips are organized and held vertically by the array of holes for ease of access. A human worker or a mechanical pipetting device simply places a pipette over the rack and lowers the distal end of the pipette into a proximal or upper end of a vertically oriented pipette tip and presses down to affix the tip, which is held to the pipette by friction.

After all the pipette tips are used the customary practice has been either to reload the rack by hand with new pipette tips purchased in bulk or dispose of the empty rack. Presently, these two customary practices each present significant disadvantage. The disadvantage or inconvenience of reloading the tips into the rack by hand is that the operation is a very time consuming process for lab workers who are generally over qualified for such repetitious work, as well, as the pipette the tips may become contaminated by manual handling. The disadvantage of disposing of the rack is that it ordinarily consists of three molded parts that still retain some value, namely the rack, itself, a cover to enclose the tips, and a base-plate to enclose and seal the bottom of the rack. Since tips are often used in large quantities, disposing of many bulky racks is wasteful and environmentally harmful. As a result, manufacturers are paying more attention to the issues that effect coat and storage space requirements, and the environment. This attention, in turn, has generated a desire to eliminate or reduce the amount of packing required to ship and store products. These concerns have driven the need to develop a new design for a pipette-tip rack.

SUMMARY OF THE INVENTION

The new design creates a reusable pipette-tip rack, conceptually, made by the joining of two standard pipette-tip racks, base-to-base, to form a rigid box or container with a central cavity. More significantly, the new design doubles the density of the number of pipette tips that can be contained in a single box or package. For example, a pipette-tip rack having a 96 hole-matrix will have pipette tips arranged in the typical eight by twelve array, however, according to the present invention, the tips are loaded into the container from both the top and bottom of the box. By off-setting the centerline spacing of the rows of holes on both top and bottom horizontal surfaces from one side of the box to the other side by approximately 4.5 mm, the new rack design is able to accommodate twice the number of pipette tips over and against other pipette tip racks that are currently available in the market. The new design interlocks or nests rows of pipette tips from one side of the box in the interstitial space, or free space, between adjacent rows of tips on the other side of the box. Thus, the proposed pipette-tip rack conserves both the amount of space for storage and material needed in manufacture. The new packaging design reduces the amount of packaging required for shipping and storing products with the use of the least amount of space, while increasing the number of pipette tips available for use within a single package.

DETAILED DESCRIPTION OF THE INVENTION

Figure 1:
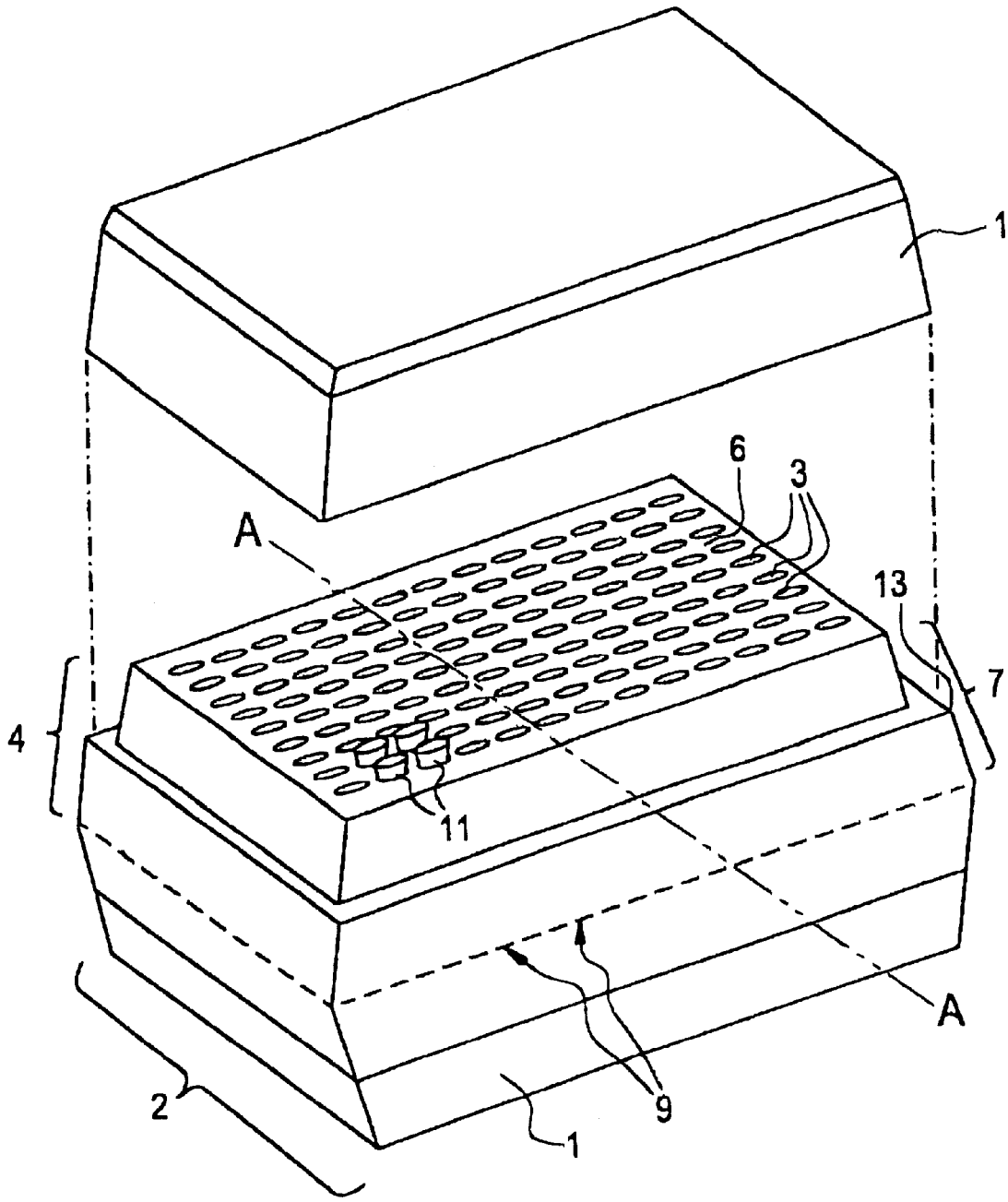
FIG. 1 is a three-quarter, perspective view of an embodiment of the present invention, with a cover removed, showing an array of holes that hold pipette tips in the upper tray.

FIG. 1 shows an embodiment of the new, reusable, pipette-tip rack design. The invention in one embodiment can be described conceptually as two identical pipette-tip-organizing trays joined together. In mental conception, one of the two trays is turned upside-down to form a lower pipette-tip tray 2, and is joined to the other tray, which forms the upper pipette-tip tray 4. The reusable pipette-tip rack, thus, comprises upper and lower pipette tip organizing trays. Each tray has an array of pipette-tip receiving holes 3 extending through a rigid, horizontal surface 6 of the tray. Rigid, vertical, side-wall members 7, joined at a contiguous edge 13 with the horizontal surface, extend therefrom. The upper 4 and lower 2 trays are joined together along a terminal edge 9 of the vertical side wall members 7, opposite the contiguous edge 13. The resulting article is a rigid box having a defined, central cavity 15 that is accessed through the rows of pipette-tip receiving holes 3 from both the upper 6 and lower 8 horizontal surfaces. The upper and lower horizontal surfaces are substantially parallel with each other.

Figure 2:
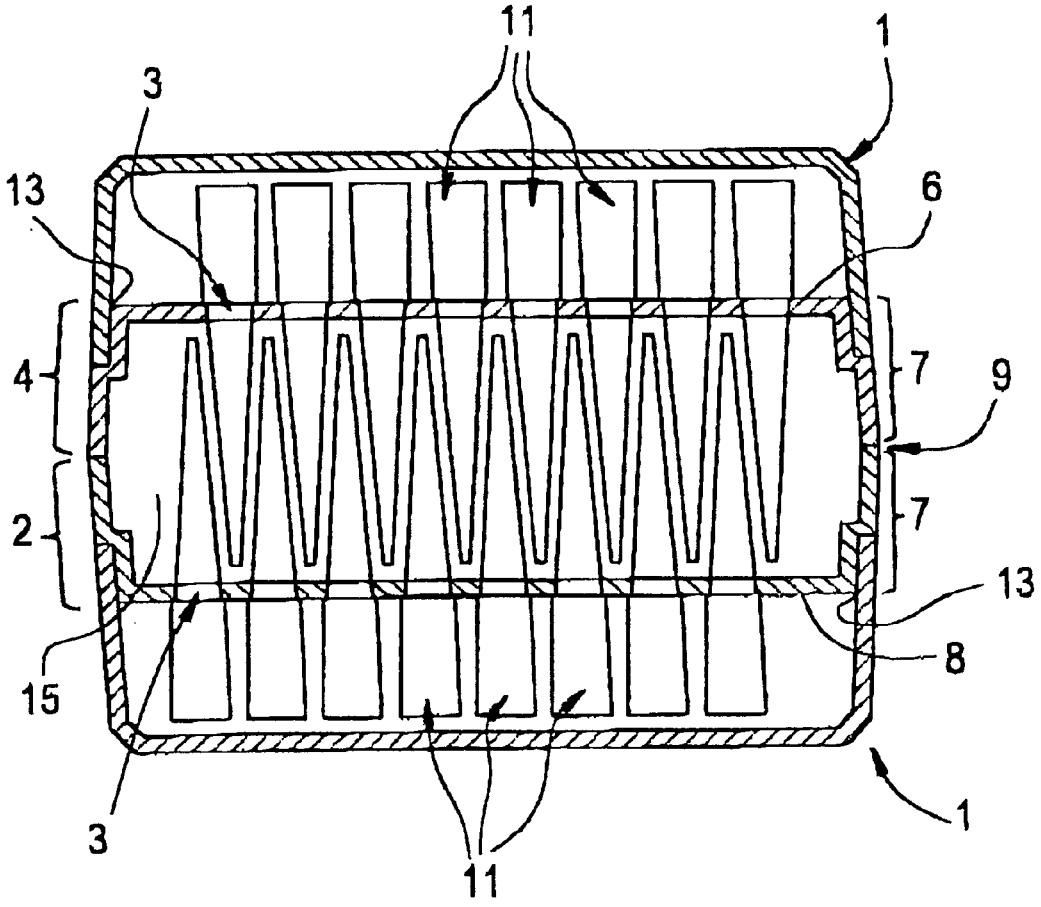
FIG. 2 is a cross-sectional view of the embodiment of the present invention depicted in FIG. 1 along the line A—A.

As can been seen in FIG. 2, the horizontal surfaces 6,8 of the upper and lower trays, respectively, form the upper and lower walls of the box, and the vertically extending side members define and form the side perimeter of the central cavity. In the horizontal surface of each tray, the centerline of each row of pipette-tip receiving holes is offset to one side from existing, standard spacing between rows of holes by about 4.5 mm. Thereby, as shown in FIG. 2, a pipette-tip-receiving hole 3 in the upper tray 4 is situated such that it is not directly in-line with its counterpart in the lower tray 2. Rows of pipette tips that extend downward from the upper tray into the central cavity nest in unoccupied (empty), interstitial spaces between adjacent rows of tips that extend upward into the central cavity from the opposing lower tray. Without increasing substantially the total height or vertical profile dimensions of the rack, the offset allows two arrays of pipette tips 11 to be loaded into the same rack from opposing sides. Each of the upper and lower trays have a cover 1 that is able to support the entire weight of the pipette-tip rack, or in other words, the combined weight of the two identical trays and pipette tips 11 loaded therein. This feature is necessary because in order to gain access to pipette tips when the pipette tips in one tray is exhausted the rack would be inverted top-side down or bottom-side up. The covers for the upper and lower trays can be fabricated either as being hinged to the rack or completely detachable.

As mentioned before, existing standard pipette-tip storage racks have a footprint of 96 pipette-tip-receiving holes. The offset of the centerline of each of the rows of pipette-tip receiving holes allows the new rack to hold twice the number of pipette tips 11 as existing racks. In a preferred embodiment, the new rack can store up to 192 pipette tips. The invention, of course, can have a varied number of pipette tips contained within, such as up to 384 tips or more.

One method of manufacture is to form the upper and lower trays together as a single piece by injection molding. A more preferred process of fabrication is to make the pipette-tip rack from two separate pieces, rather than one, so as to conserve the amount of plastics (e.g., polystyrene or polypropylene) used. The two separately molded pieces would be fused together with ultrasonic bonding, infrared light welding, snap-fit (frictional engagement), or any other conventional method for joining two plastic component parts.

The new design has a number of advantages, one of which is that it decreases the required storage space and material coats, while doubling the density of pipette tips packed in each package. The new design is also reusable because it able to be reloaded. Although a preferred embodiment of the invention has been disclosed in detail, those skilled in the art can appreciate that variations or modifications on the invention may be made, and other embodiments may be perceived without departing from the scope of the invention, as defined by the appended claims and their equivalents.

We claim:

1. A reusable pipette-tip rack comprising: upper and lower pipette tip organizing trays, each tray having an array of pipette-tip receiving holes extending through a horizontal surface, and vertical side walls, wherein said upper and lower trays form a box with a central cavity and each row of pipette-tip receiving holes in said upper tray has a centerline that is off-set relative to each row of pipette-tip receiving holes in said lower tray.

2. The reusable pipette-tip rack according to claim 1, further comprising a cover for each of said upper and lower trays.

3. The reusable pipette-tip rack according to claim 2, wherein said cover is capable of supporting the entire weight of combined upper and lower trays.

4. The reusable pipette-tip rack according to claim 1, wherein said horizontal surfaces of said upper and lower trays and said vertical side members define a perimeter of said central cavity.

5. The reusable pipette-tip rack according to claim 1, wherein said upper and lower trays permit pipette tips to be loaded vertically into said central cavity, wherein pipette tips from said upper tray nest in space between pipette tips from said lower tray.

6. The reusable pipette-tip rack according to claim 1, wherein said offset of said centerline of each row of pipette-tip receiving holes is about 4.5 mm.

7. The reusable pipette-tip rack according to claim 1, wherein said array of pipette-tip receiving holes has an eight by twelve configuration.

8. The reusable pipette-tip rack according to claim 1, wherein said rack is formed from materials selected from a group consisting of polystyrene and polypropylene.

9. A reusable pipette-tip rack comprising:

upper and lower pipette tip organizing trays, each tray having a rigid, horizontal surface in which are located an array of pipette-tip receiving holes extending through said horizontal surface, and each tray having rigid vertical side members joined at contiguous edges with said horizontal surface;

said upper and lower trays are joined along a terminal edge of said vertical side members to form a closed rigid box with a central cavity, wherein each row of pipette-tip receiving holes in said upper tray has a centerline that is off-set relative to each row of pipette-tip receiving holes in said lower tray.

10. The reusable pipette-tip rack according to claim 9, further comprising a cover for each of said upper and lower trays.

11. The reusable pipette-tip rack according to claim 10, wherein said cover is capable of supporting the entire weight of combined upper and lower trays.

12. The reusable pipette-tip rack according to claim 9 wherein said horizontal surfaces of said upper and lower trays and said vertical side members define a perimeter of said central cavity.

13. The reusable pipette-tip rack according to claim 9, wherein said upper and lower trays permit pipette tips to be loaded vertically into said central cavity, wherein pipette tips from said upper tray nest in space between pipette tips from said lower tray.

14. The reusable pipette-tip rack according to claim 9, wherein said offset of said centerline of each row of pipette-tip receiving holes is about 4.5 mm.

15. The reusable pipette-tip rack according to claim 9, wherein said array of pipette-tip receiving holes an eight by twelve configuration.

16. The reusable pipette-tip rack according to claim 9, wherein said rack is formed from materials selected from a group consisting of polystyrene and polypropylene.

* * * * *

UNITED STATES PATENT AND TRADEMARK OFFICE

CERTIFICATE OF CORRECTION

PATENT NO. : 6,514,466 B2
DATED : February 4, 2003
INVENTOR(S) : Anthony M. Labriola et al.

It is certified that error appears in the above-identified patent and that said Letters Patent is hereby corrected as shown below:

Column 4,
Line 47, please add -- has -- after “holes”.

Signed and Sealed this

Tenth Day of February, 2004

JON W. DUDAS
*Acting Director of the United States Patent and Trademark Office*